United States Patent [19]

King et al.

[11] 4,155,657

[45] May 22, 1979

[54] CONTINUOUS MIXER FOR PREPARING EMULSIONS

[75] Inventors: Gordon H. King, Batavia; Michel T. Zalzal, Cincinnati, both of Ohio

[73] Assignee: Chemed Corporation, Cincinnati, Ohio

[21] Appl. No.: 885,119

[22] Filed: Mar. 10, 1978

[51] Int. Cl.[2] ..... B01F 3/10; B01F 7/18

[52] U.S. Cl. ..... 366/171; 366/172; 366/302; 366/327

[58] Field of Search ..... 366/168, 171, 172, 173, 366/174, 302, 303, 307, 327, 329, 330

[56] References Cited

U.S. PATENT DOCUMENTS

| | | | |
|---|---|---|---|
| 317,769 | 5/1885 | Hammerle | 366/327 X |
| 1,941,808 | 1/1934 | McConnaughay | 366/302 X |
| 2,626,786 | 1/1953 | McGlothlin | 366/303 X |
| 3,212,757 | 10/1965 | Martin et al. | 366/171 X |
| 3,252,689 | 5/1966 | Blomgren et al. | 366/168 |

*Primary Examiner*—Harvey C. Hornsby
*Assistant Examiner*—John M. Jillions
*Attorney, Agent, or Firm*—Charles L. Harness

[57] ABSTRACT

A continuous mixing device for preparing emulsions comprising a chamber with a means of providing high shear mixing, e.g., a plurality of mixing blades on a shaft in the axis of the chamber, and with a plurality of entrance nozzles, e.g., at the bottom of the chamber and one or more in the sides thereof, for sequential addition of liquids at a controlled rate.

5 Claims, 4 Drawing Figures

13
1
6
14
5
14a
6a
3
6b
14b
6c
12
2
7
4
10
11
8
9
14a

CONTINUOUS MIXER FOR PREPARING EMULSIONS

This invention is directed to apparatus for forming emulsions. More particularly the apparatus comprises a vertical cylindrical chamber with internal stationary blades with entrance ports for the addition of products (e.g., water and water insoluble materials such as oils) with a central rotatable shaft within the chamber, which shaft carries a plurality of mixing blades. The upper mixing blades have a rotation and pitch such that they direct the fluids downward. The next to the bottom blades, however, have one set of blades directing the liquid downward and another set of blades directing the liquid upward. The bottom blade is the same as the upper blades and directs fluids downward.

Figures 1, 2, 3, 4:
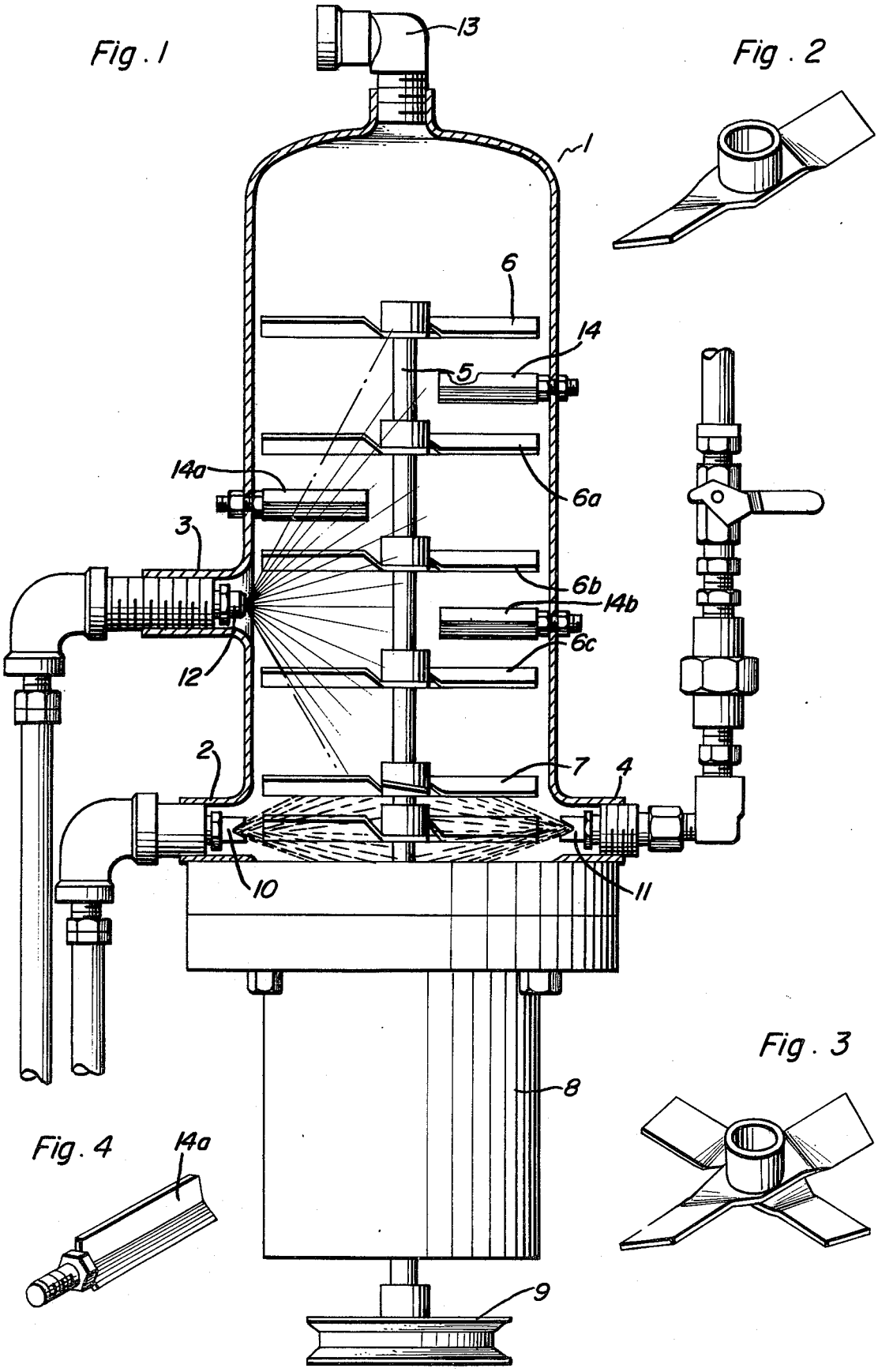
FIG. 1 is an elevation view of the apparatus of this invention.
FIG. 2 is a perspective view of one of the upper series of four sets of blades and the bottom blade.
FIG. 3 is a perspective view of the next to the bottom set of blades.
FIG. 4 is a perspective view of one of the stationary blades.

The invention is described with respect to the drawings as follows.

Referring generally to FIG. 1, the mixing device is contained generally within chamber 1, equipped with water inlets 2 and 3, and stationary blades 14, 14*a*, and 14*b*. A product inlet is shown at 4. (By "product" is meant a material insoluble in water, and this may typically be an oil.) Central shaft 5 carries a plurality of blades 6, 6*a*, 6*b*, 6*c*, 6*d*, and 7. Blades 6, 6*a*, 6*b*, 6*c*, and 6*d* are substantially identical and are pitched to drive liquid downward. Blade 7 is a 4-bladed piece and carries one set of blades to drive liquid downward and another set to drive liquid upward. All blades are fixed on central shaft 5, supported by bearings in housing 8, which is in turn driven by drive means attached to pulley 9. Drive means can typically be an electric motor (not shown). Suitably the upper set of blades (6, etc.) can be as few as two and as many as a dozen, or even more. Four are preferred. The 3-vane blades or baffles 14, 14*a*, and 14*b* are useful in providing additional shear. They can be omitted, however. If used, one can be provided between each set of stirring blades 6, 6*a*, etc., starting at the area of the water nozzle inlet 12, and going up.

The entrance lines into the chamber 1 feed into same via nozzles. Feed lines 2 and 4 feed into nozzles 10 and 11 respectively. These nozzles are of the conical type, and discharge their products as spray streams into the chamber. Inlet 3 uses a nozzle 12 which produces a flat spray discharge. The flat spray is intersected by the multiple blades giving multi-stage mixing. All nozzles are sized to give proper ratio of product and water desired for the emulsion being made. Ratios can be varied by adjusting fluid pressure and/or changing nozzles. The emulsion formed flows upward along the internal surfaces of the chamber 1 and discharges from the apparatus via outlet 13.

Typical preferred dimensions for the apparatus are as follows:

Chamber 1 is about 12 inches high by 4 inches in diameter. The blades (e.g., 6 and 7) are $3\frac{3}{4}$ inches long, 3/32 inches thick, $\frac{7}{8}$ inches wide, and the pitch is 25 to 35 degrees. The dimensions given are only representative, not critical.

In operating the emulsion-forming device, a run was made to prepare a water/fuel oil emulsion, in which the oil was in the continuous phase.

In making this run the following products and procedure were used.

80% Fuel Oil 1

10% Acycl (Coco) Amido Amine Oxide

10% Unsaturated alkyl dimethyl oxide

This mix was made up and jetted through product nozzle 11, at the rate of 0.038 gal./min. product mix. Water was fed through nozzle 10 at 0.05 gal./min., and through nozzle 12 at 1.20 gal./min. The blades were driven at 850 r.p.m. This resulted in a water-in-oil emulsion containing about 3.0% oil; the oil was the continuous phase. The apparatus was operated intermittently with no start-up problems. The emulsion was stable for periods up to two weeks.

In the continuous mixer of this invention, water and the oil phase are initially brought together in relatively equal proportions under severe agitation to form the water-in-oil emulsion. To start or prime the mixer it is essential to partially fill with oil by opening oil nozzle 11 before starting the first water input nozzle. This insures the very rich oil phase and a water-in-oil emulsion. The lower water nozzle 10 is then turned on and the chamber allowed to fill with the resulting emulsion. At this point the upper nozzle 12 is started, and following this the final emulsion is continuously generated. If stopped for several days the system can be restarted without priming.

The water is added to the emulsion while maintaining the severe agitation to make sure the water is thoroughly emulsified. Addition of water to the emulsion is controlled by the particular placement of the nozzles and their shape, the water pressure and the water flow. With each particular system of emulsifying ingredients the ratio of water going into the materials will change depending on the ratio of water desired for each particular emulsion being continuously made.

The mixing chamber as shown in FIG. 1 is just one of several kinds of shapes that might be used to mix this material. The fact that the shaft is centrally located is not really important, as one shaft, two shafts, or three shafts could all apply to mixing the material. Even the position of the water nozzles could be used as a partial mixing device to help mix the emulsion. Also the number of blades, either stationary or movable, might vary from one specific mixture to another. Other variations within the spirit and scope of the invention will be obvious to those skilled in the art.

We claim:

1. Emulsification apparatus comprising a chamber, a central shaft therein carrying a plurality of rotatable mixing blades including a next to bottom set of blades, said blades, except for the next to bottom set, being pitched so that as rotated, they force liquid toward the bottom of the chamber provided, however, that the next to bottom set of blades is pitched so as to force liquid both downward and upward; said chamber carrying at least one entrance port at the base thereof for delivery of water-insoluble product into the chamber, and at least one water inlet line.

2. Apparatus according to claim 1 in which one water inlet line is at the base of the chamber and at least one additional water inlet line above the base.

3. Apparatus according to claim 2 in which the inlet lines discharging into the base of the said chamber have spray-forming orifices.

4. Apparatus according to claim 2 in which the additional water inlet line has a flat spray discharge forming orifice providing a vertical spray pattern.

5. Apparatus according to claim 4 in which the chamber has a stationary blade fixed to its inner wall between each pair of blades pitched to force liquid toward the bottom of the chamber.

* * * * *